US010085086B2

(12) United States Patent
Shi

(10) Patent No.: US 10,085,086 B2
(45) **Date of Patent: *Sep. 25, 2018**

(54) RESONANCE DAMPING FOR AUDIO TRANSDUCER SYSTEMS

(71) Applicant: Nokia Technologies Oy, Espoo (FI)

(72) Inventor: Shengrong Shi, San Diego, CA (US)

(73) Assignee: Nokia Technologies Oy, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 15/622,251

(22) Filed: Jun. 14, 2017

(65) Prior Publication Data

US 2017/0289674 A1 Oct. 5, 2017

Related U.S. Application Data

(63) Continuation of application No. 14/432,358, filed as application No. PCT/CN2012/083129 on Oct. 18, 2012, now Pat. No. 9,813,802.

(51) Int. Cl.

| | |
|---|---|
| ***H04R 1/02*** | (2006.01) |
| ***H04R 1/20*** | (2006.01) |
| *H04R 1/28* | (2006.01) |

(52) U.S. Cl.

CPC ..... *H04R 1/20* (2013.01); *H04R 1/2842* (2013.01); *H04R 1/2819* (2013.01); *H04R 1/2888* (2013.01); *H04R 2499/11* (2013.01)

(58) Field of Classification Search

CPC ..... H04R 1/20; H04R 1/2819; H04R 1/2841; H04R 1/2888; H04R 2499/11

USPC ..... 381/346, 348, 353

See application file for complete search history.

(56) References Cited

U.S. PATENT DOCUMENTS

| | | | | |
|---|---|---|---|---|
| 3,418,437 | A * | 12/1968 | Hoffmann | H04R 1/22 381/348 |
| 3,819,879 | A | 6/1974 | Baechtold | |
| 3,896,274 | A | 7/1975 | Fraim et al. | |
| 4,054,748 | A | 10/1977 | Balogh | |

(Continued)

FOREIGN PATENT DOCUMENTS

| | | | |
|---|---|---|---|
| CN | 1420672 | A | 5/2003 |
| CN | 101006748 | A | 7/2007 |

(Continued)

OTHER PUBLICATIONS

Wang et al., "Acoustic Transducers With a Perforated Damping Backplate Based on Pzt/silicon Wafer Bonding Technique", Sensors and Actuators A: Physical, vol. 149, No. 2, Feb. 16, 2009, pp. 277-283.

(Continued)

*Primary Examiner* — Brian Ensey
(74) *Attorney, Agent, or Firm* — Harrington & Smith

(57) ABSTRACT

An apparatus comprising: an audio transducer configured to at least one of: generate sound upon receiving an audio signal provided by the apparatus; and convert sound into an audio signal to be processed by the apparatus; a housing component comprising one or more sound apertures configured to allow the transmission of sound through the one or more sound apertures; and an acoustic cavity inside the apparatus being acoustically coupled to the audio transducer using the one or more sound apertures wherein the one or more sound apertures are configured to provide an acoustic damping.

24 Claims, 16 Drawing Sheets

(56) References Cited

U.S. PATENT DOCUMENTS

| | | | | |
|---|---|---|---|---|
| 4,509,615 | A | 4/1985 | Hruby | |
| 6,704,427 | B2 | 3/2004 | Kearey | |
| 7,742,257 | B2 | 6/2010 | Acciardi et al. | |
| 2003/0096632 | A1 | 5/2003 | Kim et al. | |
| 2005/0190941 | A1* | 9/2005 | Yang | H04R 1/2819 381/351 |
| 2007/0291976 | A1 | 12/2007 | Kajiwara | |
| 2008/0219482 | A1 | 9/2008 | Sato | |
| 2008/0257642 | A1 | 10/2008 | Yamagiwa et al. | |
| 2010/0329496 | A1* | 12/2010 | Mottonen | H04M 1/0245 381/349 |
| 2011/0038495 | A1 | 2/2011 | Jeong et al. | |
| 2011/0048844 | A1 | 3/2011 | Papakyriacou | |
| 2011/0235841 | A1 | 9/2011 | Tanaka et al. | |

FOREIGN PATENT DOCUMENTS

| | | | |
|---|---|---|---|
| CN | 201114761 | Y | 9/2008 |
| CN | 101426166 | A | 5/2009 |
| CN | 102239704 | A | 11/2011 |
| JP | S5388719 | A | 8/1978 |
| WO | 2007/112404 | A2 | 10/2007 |
| WO | 2011/082510 | A1 | 7/2011 |

OTHER PUBLICATIONS

"Noise S.T.O.P Acoustic Damping Sheets", Acoustical Surfaces, Inc., Retrieved on Jun. 30, 2016, Webpage available at : http://www.acousticalsurfaces.com/noise_barrier/damping_sheets.htm?d=14.

Maa, "Potential of Microperforated Panel Absorber", The Journal of the Acoustical Society of America, 1988, pp. 2861-2868.

* cited by examiner

RESONANCE DAMPING FOR AUDIO TRANSDUCER SYSTEMS

CROSS REFERENCE TO RELATED APPLICATION

This patent application is a continuation application of copending U.S. patent application Ser. No. 14/432,358, filed on Mar. 30, 2015, the disclosure of which is incorporated by reference herein in its entirety.

TECHNICAL FIELD

This invention generally relates to the fields of acoustics and audio transducer integration and more specifically to the provision of acoustic damping for resonances using micro apertures positioned between an audio transducer and an acoustic cavity.

BACKGROUND

Mobile devices often comprise audio components (e.g. speakers, microphones) integrated within the device. Such integration of the audio components requires consideration of the mechanical and acoustic properties of the components that may at times conflict with the desired acoustic characteristics. One of the considerations relates to acoustic resonances when said transducers are integrated inside of a mobile device.

A speaker integration for hands free functionality should produce a sufficient sound pressure level, an extended bandwidth (especially low frequency response), a low level distortion etc. However, such speaker integration inside the device may start with disadvantages due to various reasons including magnet assembly being small, limited diaphragm area, limited diaphragm excursion etc. In addition, the number of use cases is increasing in todays' devices but in contrast mechanical dimensions are reduced therefore required air cavities associated with said speakers are forced to be reduced which influences the sound quality. The air cavities and acoustic apertures for speaker integrations become vital because speaker elements including transducer dimensions, diaphragm, voice coil, suspension, and permanent magnet cannot be optimised to improve the sound quality.

There is a well-known physic concerning the rear cavity volume of the speaker, which defines the sensitivity of the resulting speaker integration and the low frequency limit of the resulting integration. It is expressed as the larger the rear volume the lower the frequency or alternatively the larger the rear volume the higher the sensitivity. These rules came about because the volume inside the rear cavity has a stiffness associated with it, which depends on the rear cavity volume and the area of the speaker diaphragm that is compressing it. Therefore, the larger the diaphragm area the stiffer the air appears to be and the smaller the rear cavity volume the stiffer the air appears to be. In both cases more force is required to compress the air inside the rear cavity volume. The fundamental resonance of a speaker integration, which does not rely on any external electronic equalisation or feedback to extend the bass response, depends only on the mass of the driver, the combined stiffness of the air inside the rear cavity volume and the suspension of the diaphragm. The combination is stiffer than either the speaker or the rear cavity volume on its own, and therefore the resonance frequency is higher. For such integrations to produce lower frequency components, a larger rear cavity volume is required which in turn exhibits a smaller stiffness and hence a lower system resonance. However, such larger rear cavity volume has an impact on the device size therefore a suitable trade off must be considered.

It is known that the resonance frequency position is important but furthermore the shape of such resonance frequency is equally important for speaker integrations. Some speaker integrations can comprise a high quality factor (Q) which is a design parameter describing how under-damped a resonance is and further characterizes a resonator's bandwidth relative to its centre frequency. A high Q resonance is narrow band which rings at the resonance frequency. The rear cavity volume has a low compliance when the speaker is acoustically coupled with the small rear cavity volume. In these circumstances, such high Q resonances may produce an undesirable output signal at the resonance frequency unless a desired damping factor is applied which requires further design considerations. A typical frequency response of speaker integration may comprise one or more resonances and at least one of these resonances may be sharp peak comparing to the rest of the frequency response. It is understood that a suitable damping is introduced by means of an electronic circuitry, one or more signal processing algorithms and/or mechanical components such as damping cloth, foam materials etc. It is known that any of these considerations either individually or their combinations define the shape of resonances.

SUMMARY

Aspects of this application thus provide a resonance damping for audio transducers.

According to a first aspect there is provided an apparatus comprising: an audio transducer configured to at least one of: generate sound upon receiving an audio signal provided by the apparatus; and convert sound into an audio signal to be processed by the apparatus; a housing component comprising one or more sound apertures configured to allow the transmission of sound through the one or more sound apertures; and an acoustic cavity inside the apparatus being acoustically coupled to the audio transducer using the one or more sound apertures wherein the one or more sound apertures are configured to provide an acoustic damping.

The housing component may be at least one of: a PWB; a chassis component; a rigid or semi-rigid structure; a sintered material structure; a cover; a cover structure; and a display window.

The housing component may be adjacent to the acoustic cavity forming a cavity wall for the acoustic cavity.

At least one of the one or more sound apertures may have a diameter smaller than 0.5 mm.

The one or more sound apertures may be configured with characteristics that are selected to provide a predetermined acoustic characteristic.

The one or more sound apertures characteristics selected may include one or more of: diameter; area; pitch; thickness; pitch/diameter ratio; and total open area.

The acoustic cavity may be formed as at least one of: a rear cavity volume; and a front cavity volume, for the audio transducer.

The rear cavity volume may be substantially sealed inside the apparatus in such a way that air inside the rear cavity volume is prevented from mixing with the frontal sound waves produced by the audio transducer.

The sealed rear cavity volume may comprise sealing the acoustic coupling surface of the audio transducer around the one or more sound apertures.

The acoustic cavity may comprise two parts bisected by the housing component, such that a first part of the acoustic cavity is acoustically coupled to the audio transducer using the one or more sound apertures and a second part of the acoustic cavity is directly coupled to the audio transducer.

The acoustic cavity may be substantially sealed.

The audio transducer may be at least one of: a speaker; and a microphone.

According to a second aspect there may be provided a method comprising: providing an audio transducer configured to at least one of: generate sound upon receiving an audio signal provided by an apparatus; and convert sound into an audio signal to be processed by the apparatus; providing a housing component comprising one or more sound apertures configured to allow the transmission of sound through the one or more sound apertures; and providing an acoustic cavity inside the apparatus being acoustically coupled to the audio transducer using the one or more sound apertures wherein the one or more sound apertures are configured to provide an acoustic damping.

The housing component may be at least one of: a PWB; a chassis component; a rigid or semi-rigid structure; a sintered material structure; a cover; a cover structure; and a display window.

The method may further comprise locating the housing component adjacent to the acoustic cavity forming a cavity wall for the acoustic cavity.

At least one of the one or more sound apertures may have a diameter smaller than 0.5 mm.

The method may further comprise selecting at least one characteristic of the one or more sound apertures to provide a predetermined acoustic characteristic.

The at least one characteristic may comprise one or more of: diameter; area; pitch; thickness; pitch/diameter ratio; and total open area.

Providing the acoustic cavity may comprise forming the acoustic cavity as at least one of: a rear cavity volume; and a front cavity volume, for the audio transducer.

The method may further comprise sealing substantially the rear cavity volume inside the apparatus in such a way that air inside the rear cavity volume is prevented from mixing with the frontal sound waves produced by the audio transducer.

Sealing substantially the rear cavity volume may comprise sealing the acoustic coupling surface of the audio transducer around the one or more sound apertures.

Providing the acoustic cavity may comprise forming the acoustic cavity in two parts bisected by the housing component, such that a first part of the acoustic cavity is acoustically coupled to the audio transducer using the one or more sound apertures and a second part of the acoustic cavity is directly coupled to the audio transducer.

Providing the acoustic cavity may comprise substantially sealing the acoustic cavity.

The audio transducer may be at least one of: a speaker; and a microphone.

According to a third aspect there is provided an apparatus comprising: transducer means for at least one of: generating sound upon receiving an audio signal provided by the apparatus; and converting sound into an audio signal to be processed by the apparatus; housing means comprising one or more sound apertures configured to allow the transmission of sound through the one or more sound apertures; and cavity means inside the apparatus being acoustically coupled to the transducer means using the one or more sound apertures wherein the one or more sound apertures are configured to provide an acoustic damping.

The housing means may be at least one of: a PWB; a chassis component; a rigid or semi-rigid structure; a sintered material structure; a cover; a cover structure; and a display window.

The housing means may be adjacent to the cavity means forming a cavity wall for the cavity means.

At least one of the one or more sound apertures may have a diameter smaller than 0.5 mm.

The one or more sound apertures may be configured with characteristics that are selected to provide a predetermined acoustic characteristic.

The one or more sound apertures characteristics selected may include one or more of: diameter; area; pitch; thickness; pitch/diameter ratio; and total open area.

The cavity means may be formed as at least one of: a rear cavity volume; and a front cavity volume, for the audio transducer.

The rear cavity volume may be substantially sealed inside the apparatus in such a way that air inside the rear cavity volume is prevented from mixing with the frontal sound waves produced by the transducer means.

The sealed rear cavity volume may comprise sealing the acoustic coupling surface of the transducer means around the one or more sound apertures.

The cavity means may comprise two parts bisected by the housing means, such that a first part of the cavity means is acoustically coupled to the transducer means using the one or more sound apertures and a second part of the cavity means is directly coupled to the transducer means.

The cavity means may be substantially sealed.

The transducer means may be at least one of: a speaker; and a microphone.

Embodiments of the present application aim to address problems associated with the state of the art.

SUMMARY OF THE FIGURES

For better understanding of the present application, reference will now be made by way of example to the accompanying drawings in which.

DETAILED DESCRIPTION OF EMBODIMENTS OF THE INVENTION

Figure 1:
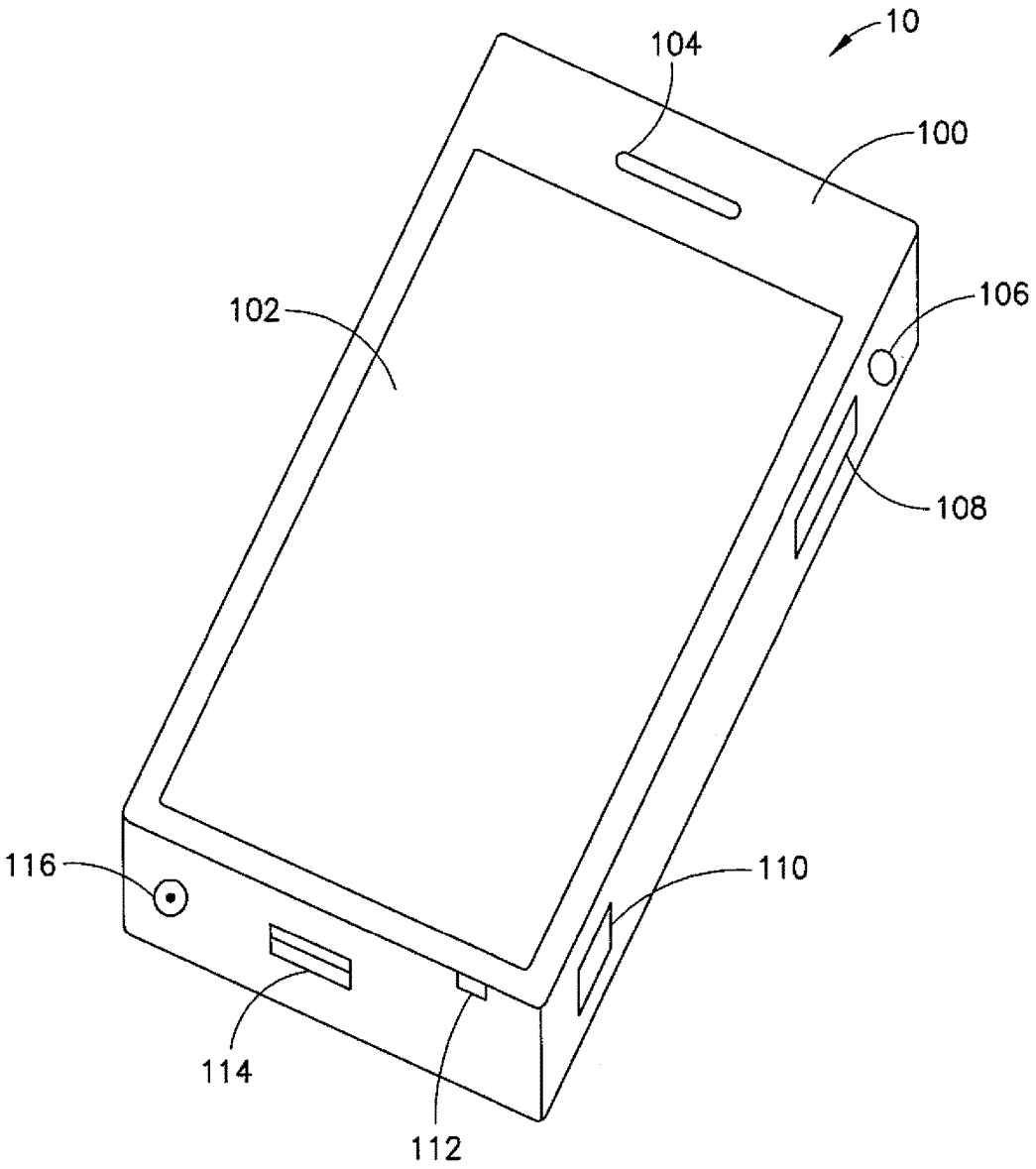
FIG. 1 shows schematically an electronic device apparatus employing some embodiments.

The following describes in further detail suitable apparatus and possible mechanisms for an illustration of an example system comprising the known solution for a sound generating system. The apparatus as shown in FIG. 1 is in the form of a mobile phone. However it would be appreciated embodiments of the application may be implemented within any devices or apparatus containing a transducer which may be a speaker module. For example in other embodiments the apparatus can be an electronic device such as a music player or a wireless communication system, for example, a mobile telephone, a smartphone, a PDA, a computer, a music player, a video player, or any other type of device adapted to output an audio signal.

The audio signal, such as a music signal, can as described herein be suitably processed using digital signal processing (DSP) together with an audio amplifier before the speaker module. The speaker module is suitably integrated inside the electronic device comprising one or more acoustic cavities, one or more sound apertures to form a speaker system.

In an example embodiment, the audio signal such as a music signal, can be processed in such a way that an equalizer, which can include a filter configured to reduce the vibration resonance of the speaker system which may comprise an high Q-factor resonance. It is known that a speaker system with a sharp resonance may not produce a pleasant sound.

A multi-band dynamic range controller (DRC) in some embodiments could process the audio signal in order to boost the energy of quieter frequencies in a low frequency band. For example, a DRC band can be applied for the lower frequency band aggressively whereas an alternative DRC band can be applied to produce a softer effect for the upper frequency band.

It is known that a speaker system for a portable device could be designed with either substantially sealed back cavity or an open back cavity or a back cavity with a bass reflex port. It is understood that the speaker integration resonance may possess different characteristics based on the integration type. For example where the speaker module is configured with a closed back cavity inside the apparatus, the fundamental resonance could occur in a range between 400 Hz to 1.2 kHz. A speaker system can be designed to have a very narrow fundamental resonance (high Q-factor) at the resonance frequency which provides high enough sensitivity but produce a poor sound.

The speaker system as described herein comprises a moving coil speaker module however similar integration methods and apparatus can be applied to other types of transducer such as piezo and electrostatic loudspeakers. In such speaker integrations the back cavity requirement is also relevant and thus any speaker system radiating sound waves front and back can benefit from the embodiments as described herein.

The mobile phone 10 may in some embodiments comprise an outer cover 100 which houses some internal components. The outer cover 100 may comprise a display region 102 through which a display panel is visible to a user. The outer cover in some embodiments comprises a sound aperture 104. In these embodiments the sound aperture 104 may further include a separate bezel for the sound aperture 104 or in some other embodiments may be formed as part of the outer cover 100 or the display region 102. When the sound aperture 104 is placed adjacent to a user's ear, sound generated by an earpiece module (not shown) is audible to the user. The mobile phone 10 may further comprise a volume control button 108 with which the user can control the volume of an output of the speaker modules. The mobile phone 10 comprises at least one sound outlet 114 which may be used to radiate sound waves generated by a speaker module (not shown). The speaker module may be a loudspeaker and in some embodiments the loudspeaker can be a multi-function-device (MFD) comprising a vibra functionality wherein an electronic signal is converted into a vibration. The MFD component having any of the following: combined earpiece, integrated handsfree speaker, vibration generation means or a combination thereof. In further embodiments the mobile phone 10 comprises a separate vibra module in order to provide a vibra functionality.

The speaker system may be used for handsfree operations such as music playback, ringtones, handsfree speech and/or video call. The sound outlet 114 couples the acoustic output of the speaker module to exterior of the mobile phone 10. In some embodiments, the sound outlet 114 may comprise a suitable mesh structure or grill which may take various forms, shapes or materials and which may be designed in relation to the frequency response of the speaker module 114. The sound outlet 114 may be structured as an array of individual small openings or may be a single cross section area. The sound outlet 114 may be rectangular or cylindrical or may be any other suitable shape. At least one microphone outlet 112 for a microphone module (not shown) may be suitably positioned in mobile phone 10 to capture the acoustic waves by at least one microphone and output the acoustic waves as electrical signals representing audio or speech signals which then may be processed and transmitted to other devices or stored for later playback.

The mobile phone 10 may provide interfaces enabling the user to interface external devices or equipment to the mobile phone 10. For example an audio connector outlet 106 may be suitably positioned in the mobile phone 10. In some embodiments, the audio connector outlet may be substantially hidden behind a suitably arranged door or lid. The audio connector outlet 106 may be suitable for connection with an audio connector (not shown) or may be suitable for connection with an audio or audio/visual (A/V) connector. The audio connector provides releasable connection with audio or A/V plugs (not shown). These plugs provide an end-termination for cabling and are used to connect a peripheral device to the mobile phone 10. In this way, the mobile phone 10 is able to output audio or A/V and receive audio or A/V input. Such audio or A/V plugs are often called round standard connectors and may be in different formats which may comprise at least two contacts. The external device such as a headset may itself comprise a microphone or suitable connection for a microphone or further connection suitable for end terminating further cabling. The audio connector and/or associated plug may be a standardized 2.5 mm or 3.5 mm audio connector and plug. It is accordingly understood the audio connector outlet 106 may be formed comprising a suitably arranged cross section area.

The mobile phone 10 may further comprise in some embodiments a universal serial bus (USB) interface outlet 110. The USB interface outlet 110 is suitably arranged for a USB connector (not shown). The mobile phone 10 may further require a charging operation and therefore comprise a charging connector 116. The charging connector 116 may be of various sizes, shapes and combinations or in some embodiments can be visually or substantially hidden.

Figure 2:
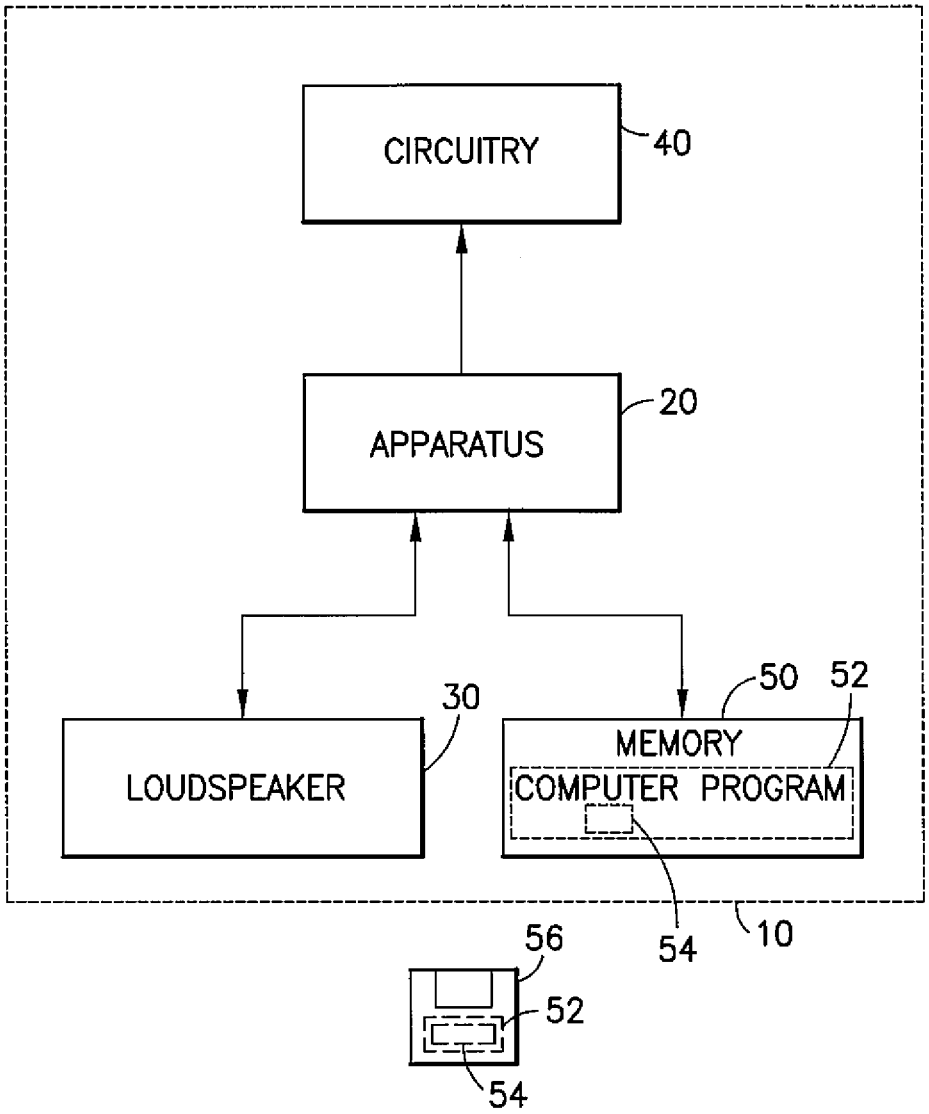
FIG. 2 shows schematically the electronic device shown in FIG. 1 in further detail.

In FIG. 2, a schematic block diagram of the exemplary mobile phone 10 according to some embodiments is explained in further detail. The mobile phone 10 comprises a processing circuitry 20. The processing circuitry 20 and the speaker module 30 are operationally coupled and any number or combination of intervening elements can exist between them (including no intervening elements). The processing circuitry 20 is configured to output a suitable electrical signal to the speaker module 30 to generate acoustic signals. The electrical signal can in some embodiments be a first component of an electrical audio signal, where the first component comprises a frequency band of the electrical audio signal comprising one or more frequency components. The speaker module 30 is configured to convert the first component into the acoustic signal. The processing circuitry in some embodiments can output a second component of the electrical audio signal to a different transducer, for example a vibra module, providing the vibra function. The second component comprises a low-frequency band of the electrical audio signal. In alternative embodiments the different transducer may be a second speaker module.

The electronic device 10 also comprises a memory 50, and a circuitry 40.

The processing circuitry 20 is configured to provide electrical outputs to the speaker module 30 and receives electrical inputs from the circuitry 40. The processing circuitry may comprise a digital-to-analogue converter (DAC) to the speaker module. In some embodiments the speaker module may be used as an earpiece module suitable for handset speech call. The mobile phone 10 further comprises at least one microphone and an analogue-to-digital converter (ADC) configured to convert the input analogue audio signals from the at least one microphone into digital audio signals.

The mobile phone 10 may comprise multiple transducer modules that may serve different use cases. An audio connector provides a physical interface to an external module such as a headphone or headset or any suitable audio transducer equipment suitable to output from the DAC. In some embodiments the external modules may connect to the mobile phone 10 wirelessly via a transmitter or transceiver, for example by using a low power radio frequency connection such as Bluetooth A2DP profile. The processor is further linked to a transceiver (TX/RX), to a user interface (UI) and to a memory 22.

The processing circuitry and/or the circuitry may be configured to execute various program codes. The implemented program codes may in some embodiments comprise individual settings for generating suitable audio signals to the loudspeaker 33 and/or the second transducer. The implemented program codes may be stored for example in the memory for retrieval by the circuitry whenever needed. In some embodiments, the codes are adaptively generated suitable for dedicated use cases. The memory 50 could further provide a section for storing data, for example data that has been processed in accordance with the embodiments.

The speaker module 30 may comprise one or more magnets, a voice coil and a membrane. At least one of the magnets is an electromagnet. When an electrical signal is provided to the electromagnet by the processing circuitry 20, attraction and repulsion between the voice coil and at least one magnet causes the membrane to move, which results in sound being produced by the speaker module 30.

As described herein mobile phone acoustic design is such that there can be a problem regards to the excursion of a speaker being too large to impact the reliability. In other words a sufficiently low resonance damping can cause problems in the speaker transducer overshooting and physically impacting the transducer membrane on a surface. Thus damping can prevent a speaker from damaging itself when being overdriven. Furthermore due to current design ethos there is a problem that there are very few design variables which can be adjusted in a speaker system integration design and typically cavity volume (acoustic capacity) and openings length and area (acoustic mass) are designed to change the response of the speaker.

For example a speaker typically used in a phone would have a Q-factor as high as 1.4 while a fourth order Butterworth vented design requires a Q-factor approximately 0.7 to 0.8. The concept behind embodiments as described herein is to introduce a new and significantly more practical and cheaper way to implement capillary damping for acoustic damping purposes. The acoustic damping can be used for example to prevent the speaker from overshooting or applied in new structures as a tunable element for the speaker integration. An acoustic capillary typically refers to a hole with a diameter which is very small typically less than or equal to 0.2 mm. When the acoustic hole or capillary is small enough the resistance due to the viscosity will be large enough to impact the resonance system of the speaker implementation. The concept behind these capillaries as described herein is to reuse the printed wiring board for printed circuit board and in particular through holes within the printed wiring board as capillaries for acoustic damping purposes. Printed wiring board manufacture typically implements through holes as grounding between different layers. In the embodiments as described herein the diameter of the through holes can be made to a similar level as an acoustic capillary tube. Furthermore as described herein by adding or reusing copper plating within the inner side of a printed wiring board hole as a heat conductive material the adiabatic compression of the sound wave in the hole produces a heating effect which produces a constant temperature compression when copper capillaries are applied adding further dampening effect because of the heat energy loss.

Implementation of the processing circuitry and/or the circuitry can be in hardware alone (a circuit, a processor . . . ), have certain aspects in software including firmware alone or can be a combination of hardware and software (including firmware).

The processing circuitry and/or the circuitry may be implemented using instructions that enable hardware functionality, for example, by using executable computer program instructions in a general-purpose or special-purpose processor that may be stored on a computer readable storage medium (disk, memory etc) to be executed by such a processor.

Figure 3:
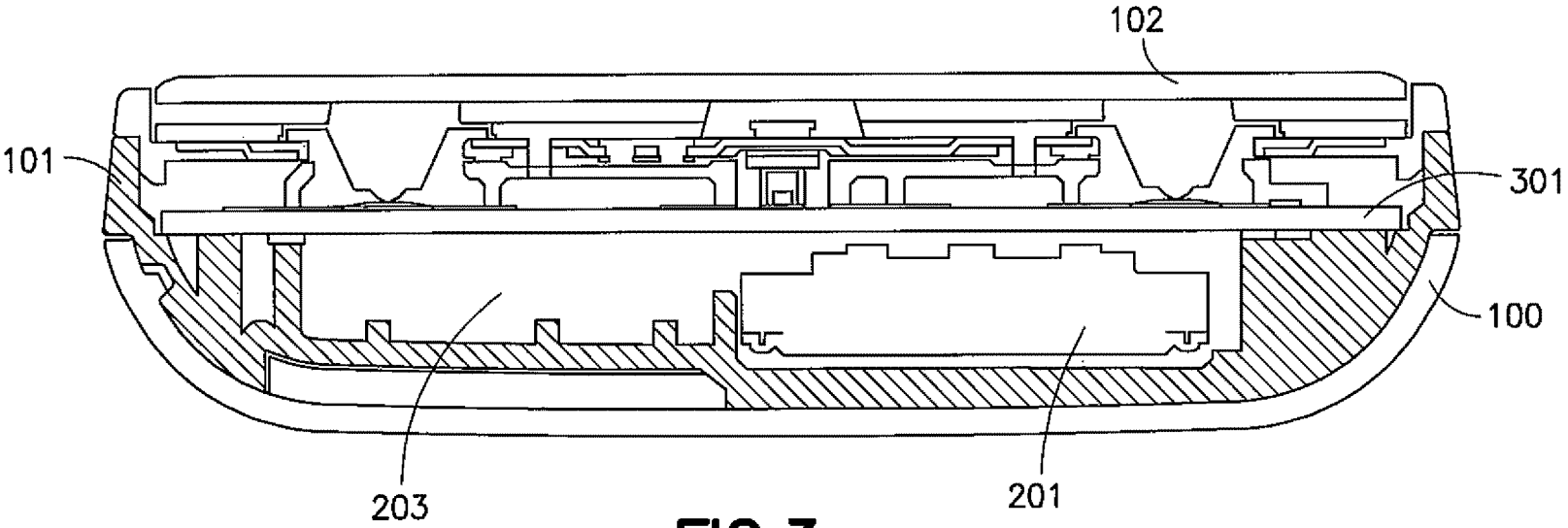
FIG. 3 shows schematically an example sectioned view of a conventional mobile apparatus speaker integration.

With respect to FIG. 3 a sectioned view of an example of a conventional speaker integration package within an apparatus is shown. The apparatus as shown in FIG. 3 comprises a chassis/cover 101 on which much of the apparatus is suspended, an outer cover 100 which surrounds the rear of the apparatus and is coupled to the rear of the chassis/cover 101, and a display assembly 102 at the front of the apparatus also coupled to the chassis/cover 101. Within the apparatus is located a printed wiring board (PWB) 301 or printed circuit board (PCB) which is mounted on an internal part of the chassis/cover 101 and on which one side of the printed wiring board various electronic components can be mounted. On the underside of the printed wiring board 301 is located the speaker module 201. Located adjacent to the speaker module and formed by a void between the printed wiring board 301 and the chassis/cover 101 is the rear or back cavity 203. As described herein the back cavity is a volume of space which 'tunes' the speaker module 201. Within a conventional design speaker integration design the back cavity 203 has a sealed back cavity of specific volume and shape to tune the speaker 201. However as described herein ongoing design considerations require the reduction of volume of the back cavity 203 region and as such small back cavity 203 volume of poor shape choice or design can lead to poor quality audio reproduction by the speaker 201 and/or possible damage of the speaker module 201 due to a lack of control over the excursion.

Figure 4:
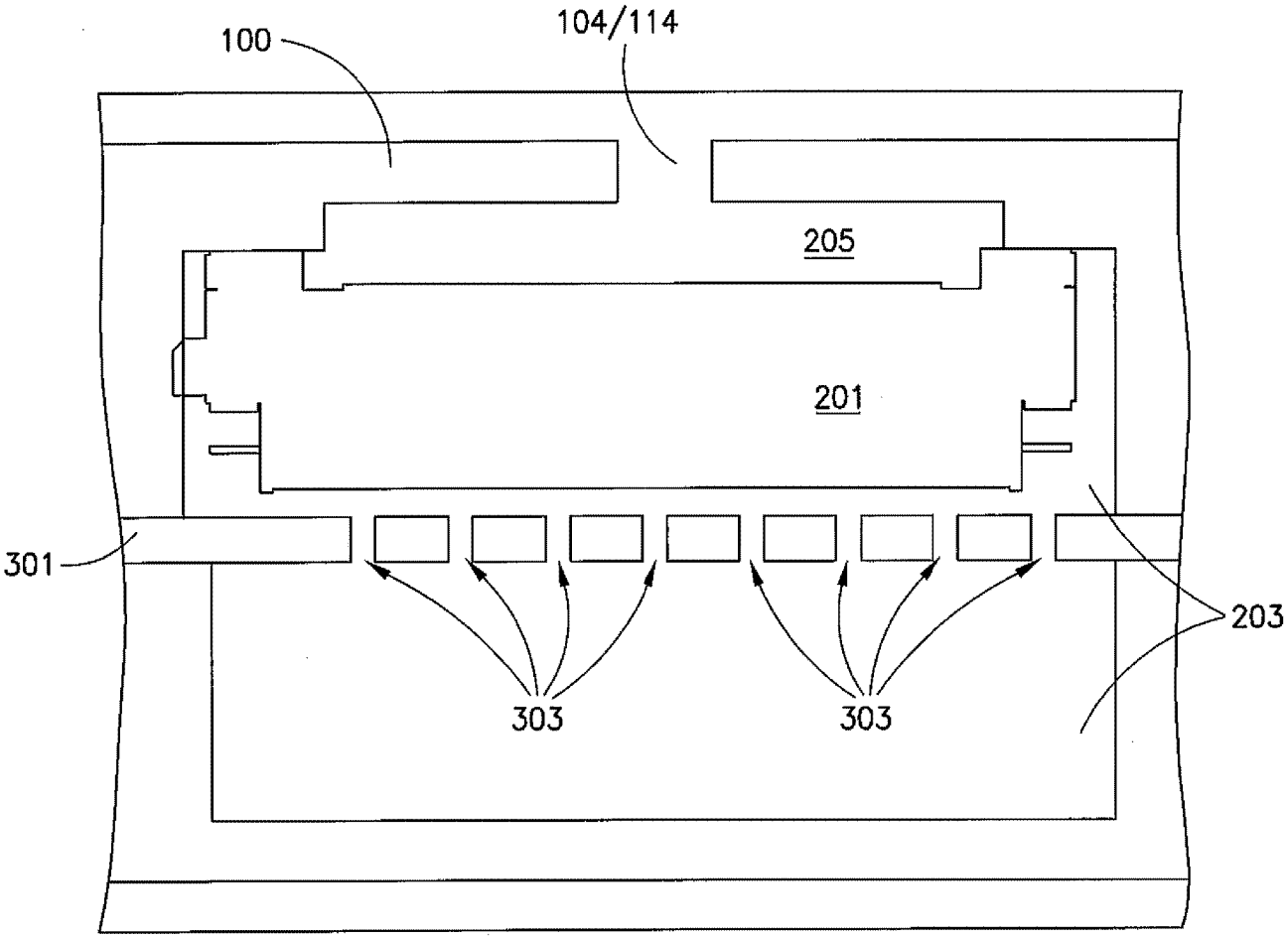
FIG. 4 shows schematically an example sectioned view of a mobile apparatus speaker integration according to some embodiments.

With respect to FIG. 4 an example sectioned view of a mobile apparatus speaker integration according to some embodiments is shown. The apparatus comprises the cover 100 through which there is an opening 104/114 through which the acoustic waves can pass. Beneath the cover 100 and between the cover and the speaker module 201 is the front cavity 205. Behind the front cavity 205 is the speaker module 201 (or transducer). In the embodiments shown herein the speaker module 201 is mechanically fixed to the cover 100 to form a void between the cover 100 and the speaker module 201 forming the front cavity 205. Formed in the void between the speaker 201 and the chassis and/or rear cover element is the back cavity 203. The back cavity 203 in the example shown in FIG. 4 is bisected or sectioned into at least two portions by the printed wiring board 301. In other words the acoustic cavity can be considered to comprise at least two parts or portions of which at least two of the parts are separated by the printed wiring board 301. Within the printed wiring board 301 is located a plurality of capillaries 303 or tubes or holes which link the back cavity 203 sections. The one or more capillaries (sound apertures) may be micro-holes provided by configuring the structure where the micro-holes are positioned using parameters such as diameter, pitch (distance between the centres of adjacent micro-holes), area, thickness etc., and considerations of the type of material and surface finish of the structure. In some embodiments, the structure and said micro-holes may be located and dimensioned in such a way as to provide the best compromise between design, mechanics, and audio requirements. Herein, the term capillary or micro-hole is used to describe openings such as pores, holes, apertures, micro-apertures or the like, which are substantially small for providing acoustic damping. Further, such openings may be circular or non-circular, for example, elliptic shape openings, slits, slots, regular or non-regular shapes, or the like, may be provided in some embodiments.

In some embodiments the capillaries are through holes in the printed wiring board 301. Through holes in printed wiring boards are conduits which typically enable inter-layer electrical connections or couplings where the printed wiring board comprises multi-layers of electrical layouts. In other words the placement of suitable through holes in the printed wiring boards can be used as the capillary couplings between the back cavity 203 sections.

Furthermore although in the following discussion the holes, capillaries, or tubes are described with respect to a component external to the speaker (or microphone) housing, for example a printed wiring board or mesh, it would be understood that in some embodiments the partially sealing member and the holes can be formed within the housing or module itself. For example in some embodiments the speaker (or microphone) module comprises a transducer and within the transducer housing is a material with the holes which dampens the response for a volume or cavity. In such embodiments one of the parts of the cavity exists at least partially externally to the housing and one of the parts of the cavity exists completely internally to the housing with the housing material operating as the sealing which is opened by the holes in the material. In some embodiments the material is the housing and the holes are in the housing allowing the flow of air between a first cavity part in the housing and a second cavity part external to the housing. In such embodiments the manufacturer can thus place the single module inside the apparatus.

In some embodiments the transducer module (for example a speaker or microphone module) can comprise the acoustic cavity and the cavity divider with the holes (capillaries or tubes) as well as the transducer. In such embodiments the transducer module is itself tuned in such a way to dampen the Q-factor of the transducer without any external components required. In other words the transducer module can in such embodiments be inserted within the apparatus as a unit that requires only some small additional design or external design effort such as connecting or coupling to the apparatus printed wiring board.

In some embodiments there can be more than one cavity divider. For example in some embodiments the transducer housing can comprise a divider material as described herein and the transducer housing be located on a printed wiring board with further microholes, tubes or capillaries, to define a first cavity part within the housing, a second cavity part between the housing divider and to the printed wiring board and a third cavity part between the printed wiring board and the casing (and in some embodiments, such as a front cavity, the acoustic hole(s) through which acoustic energy can pass through the casing). The size, spacing, distribution of the holes can be used to tune the resonance of the transducer.

Figure 7A:
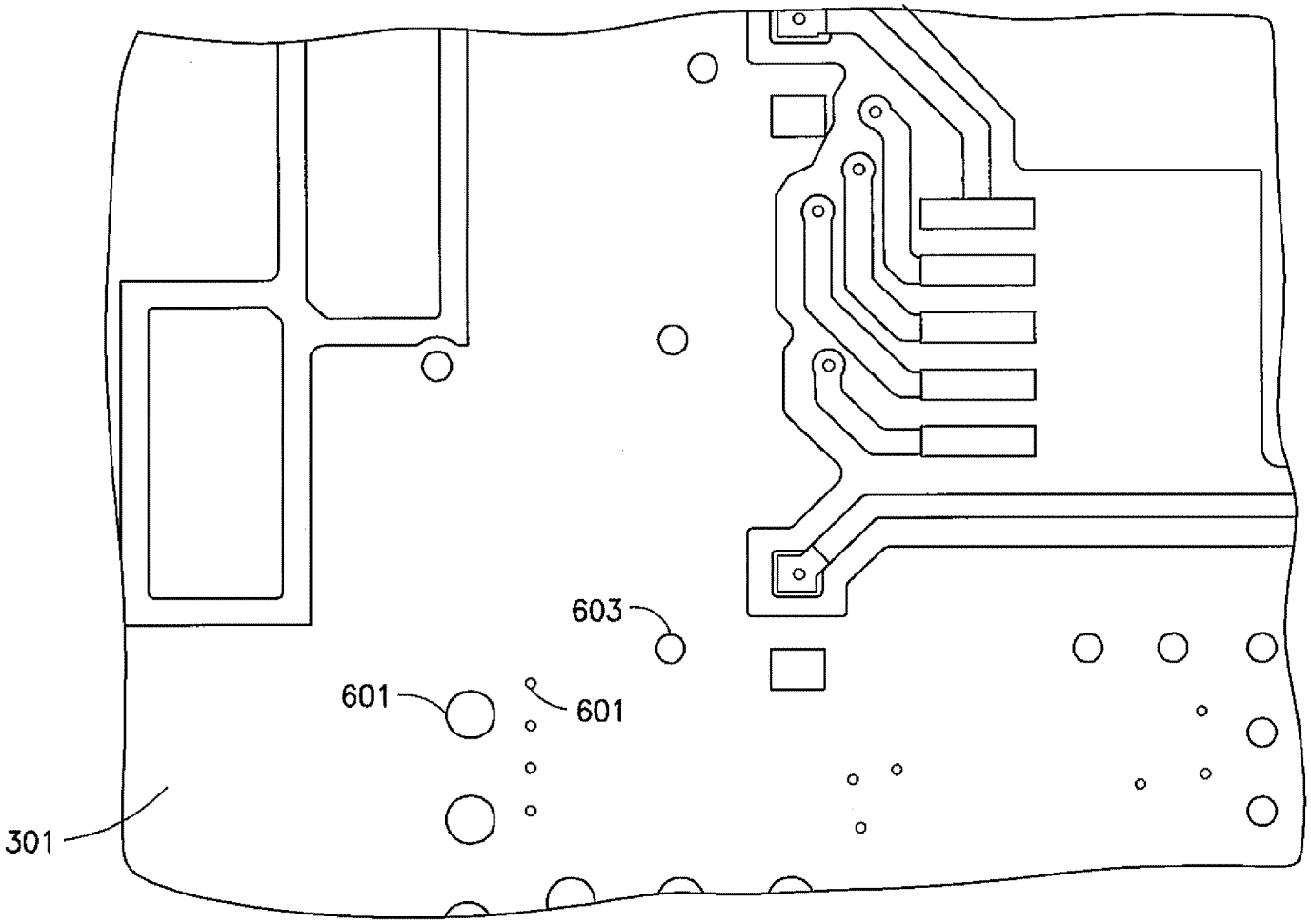
FIGS. 7*a* and 7*b* show schematically views of a printed wired board mobile speaker integration according to some embodiments.

With respect to FIG. 7*a* an example printed wiring board configurations with through holes suitable for implementing capillary couplings between the back cavity 203 sections is shown. The printed wiring board 301 shown in FIG. 7*a* shows various through holes from large through holes 601, medium through holes 603 and small through holes 605. It would be understood that the location, size and arrangement of the through holes is at least partially dependent on the printed wiring board electrical circuit layout, however it would be understood that in some embodiments the area of the printed wiring board used for the through holes in some embodiments can be an electrically isolated section from the rest of the electrical circuitry. Furthermore it would be understood that conventional printed wiring board manufacturing such as printed wiring board PTH (Plated Through Hole) technology can drill mechanical capillaries as small as 0.2 mm without the need for additional tooling.

In some embodiments rather than re-use through holes which have been designed with respect to the printed wiring board to couple electrical circuitry additional through holes can be added. These can either be drilled, for example using PTH technology or using additional tooling to reduce the diameter or spacing of the holes. With respect to FIG. 7*b* an example printed wiring board configuration with an array 791 of additional through holes 611 are. In the example shown in FIG. 7*b* the 25×16 capillary grid is generated using laser burning to achieve a hole diameter less than 0.2 mm. Although the grid 791 of the through holes 611 are shown in a rectangular grid or array it would be understood any suitable two-dimensional configuration, layout or spacing of the through holes can be implemented.

In general the acoustic resistance of a capillary system can be expressed as the following formula:

$$R = \rho c \frac{0.147}{d^2} \cdot \frac{t}{p} \cdot \left( \sqrt{1 + \frac{x^2}{32}} + \frac{\sqrt{2}\,x}{8} \cdot \frac{d}{t} \right)$$

Where:

$$x = \sqrt{\frac{\rho\omega}{\eta}} \cdot \frac{d}{2};$$

d is the diameter of capillary; η is the viscosity coefficient; t is the length of the capillary; p is the ratio of opening area and total area; ρ is the density of air; and c is the sound velocity in the air.

From the above formula, it can be easily found that the diameter, length and opening percentage of an area can decide the total resistance. However it would be understood that the length of the capillary, which in the above embodiments equals the thickness of PWB, is usually fixed.

Figure 7B:
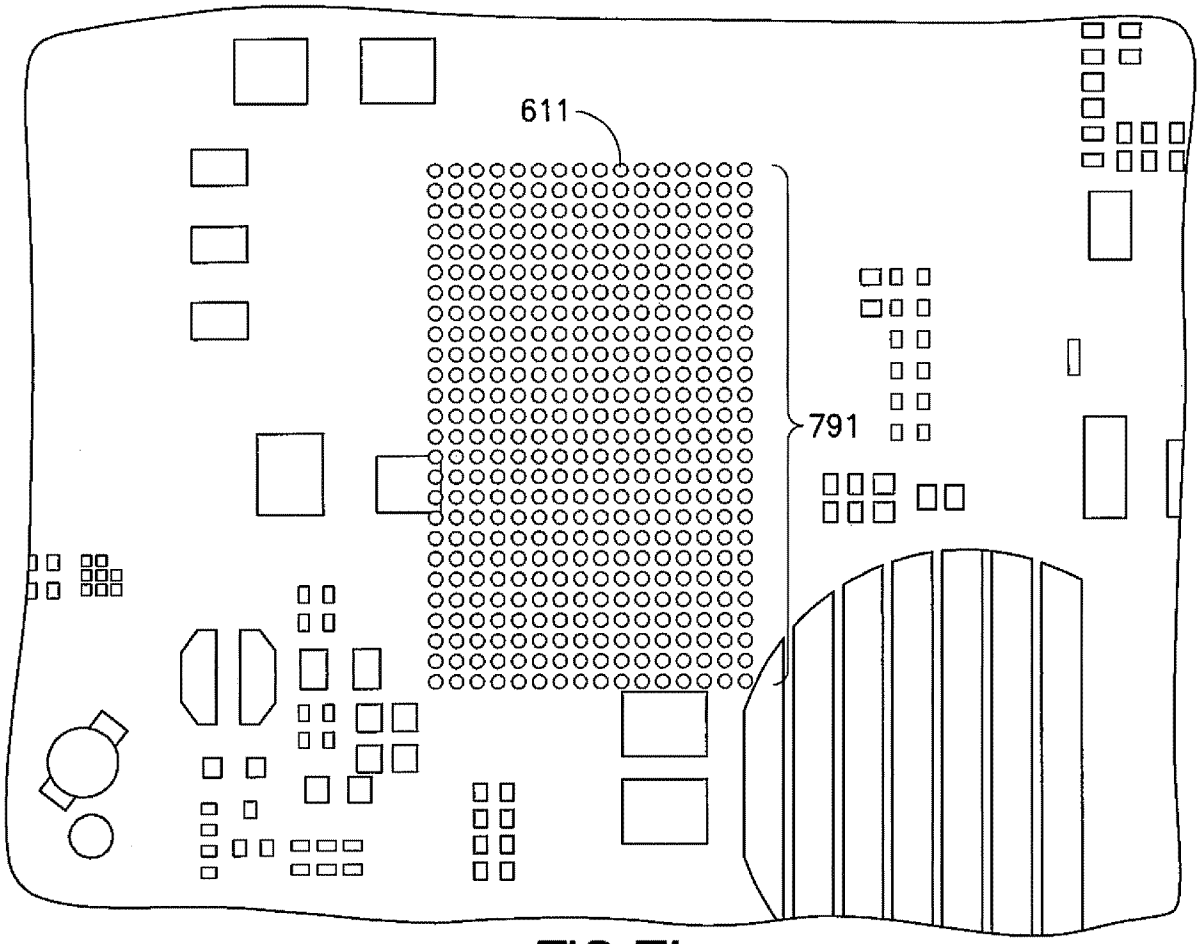
Figure 12:
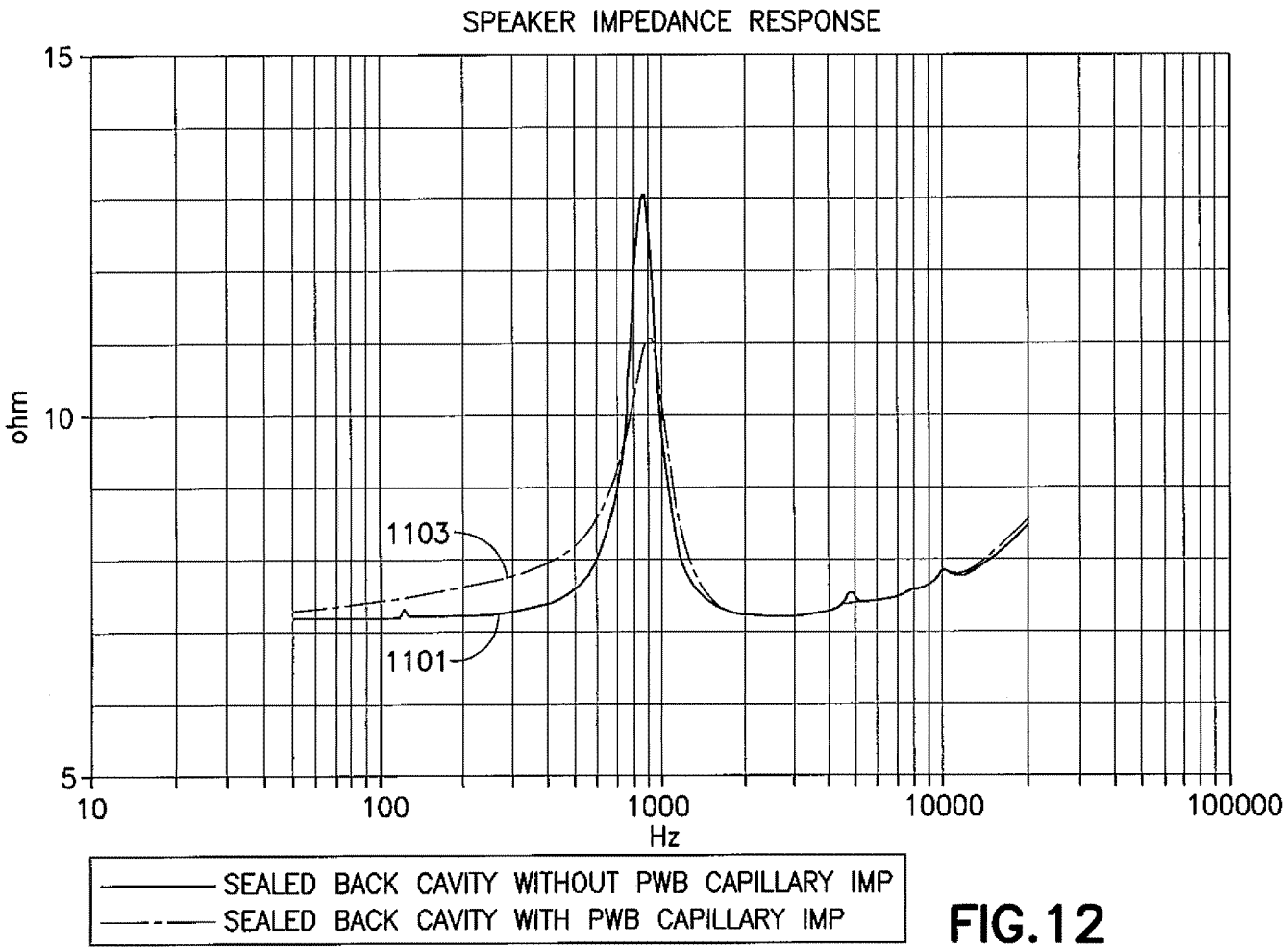
FIG. 12 shows a graph of an example mobile apparatus speaker integration speaker impedance response for conventional mobile speaker integration and mobile speaker integration according to some embodiments.
Figure 13:
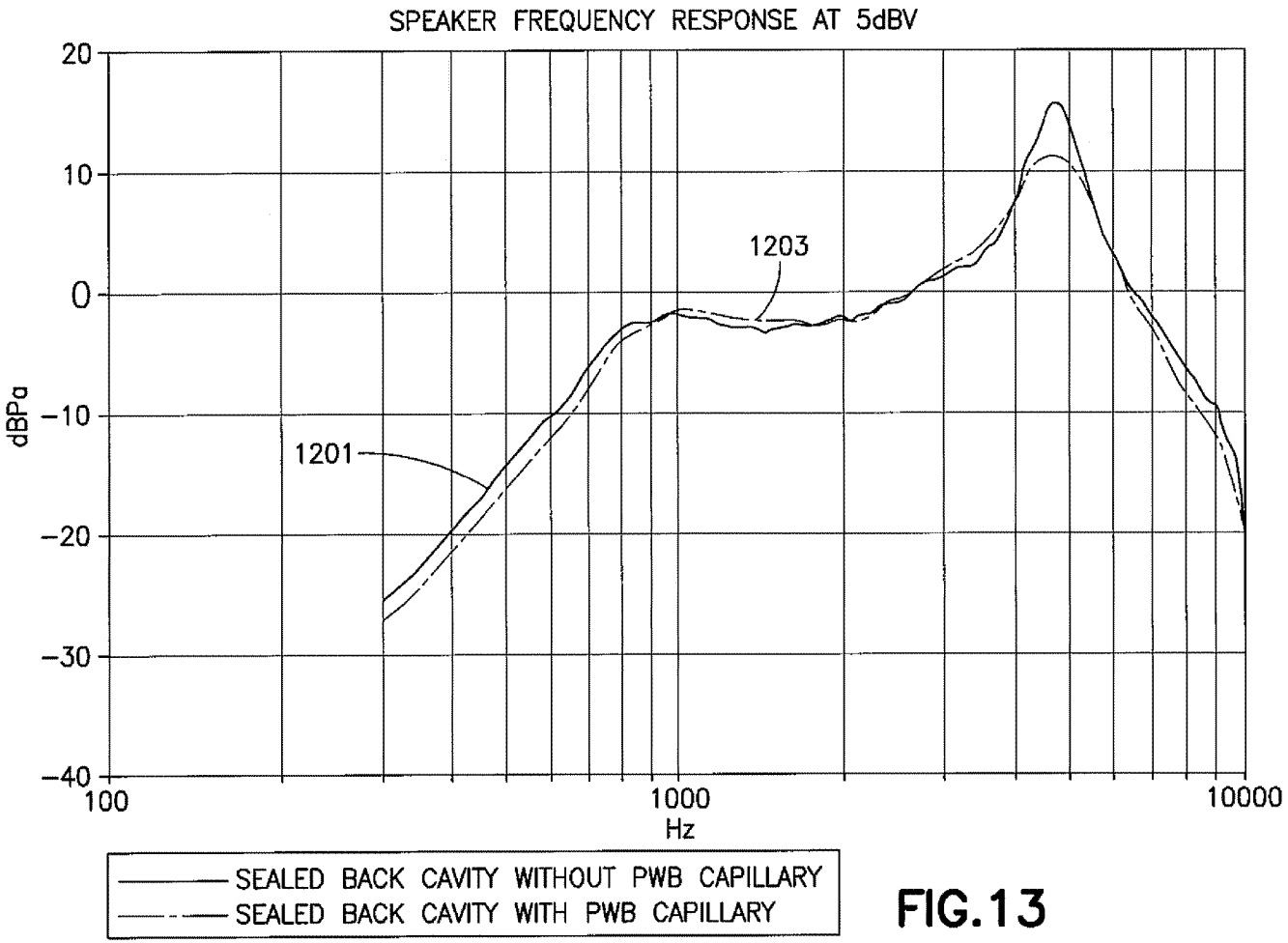
FIG. 13 shows a graph of an example frequency response for conventional mobile speaker integration and mobile speaker integration according to some embodiments.

The array grid as shown in FIG. 7*b* when implemented in a speaker module implementation such as shown in FIG. 3 was tested and the resultant frequency response and speaker impedance response (Q-factor) shown in FIGS. 13 and 12 respectively.

For example in FIG. 12 the speaker impedance response for both a PWB non-capillary sealed back cavity speaker implementation shown by trace 1103 and the sealed back cavity with PWB capillaries speaker implementation (as described herein) shown by trace 1101 is shown. The capillaries significantly reduce the Q-factor and furthermore the excursion is reduced from 0.63 mm to 0.41 mm a 35% reduction.

FIG. 13 shows the speaker frequency response for both a PWB non-capillary sealed back cavity speaker implementation shown by trace 1201 and the sealed back cavity with PWB capillaries speaker implementation (as described herein) shown by trace 1203 is shown showing that these speaker frequency responses are substantially similar.

Figure 6:
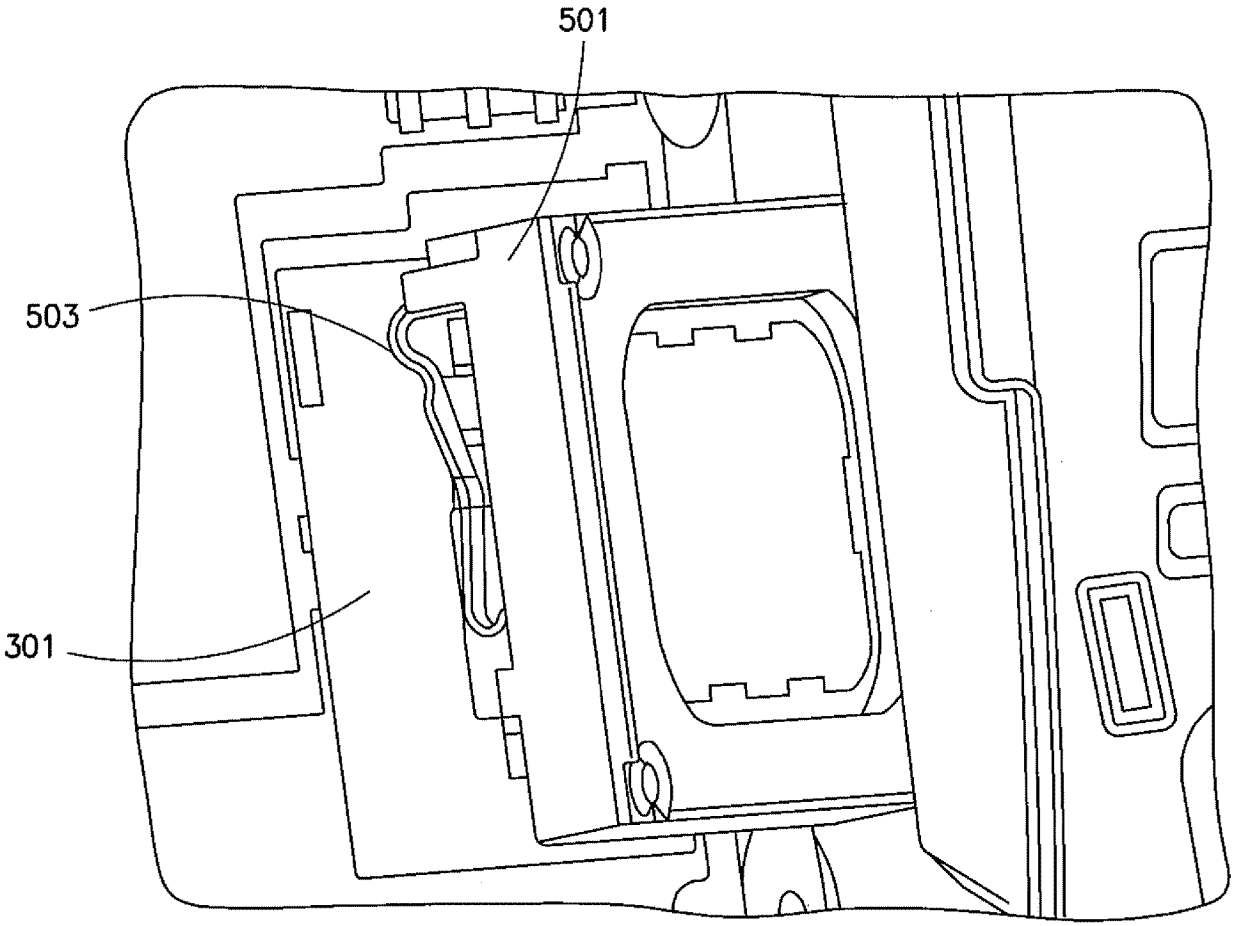
FIG. 6 shows schematically an example three dimensional projection of a mobile apparatus speaker integration according to some embodiments.

With respect to FIG. 6 an example three-dimensional projection of a mobile apparatus speaker integration is shown where the speaker module 201 is coupled electrically via a leaf spring 503 to the printed wiring board 301 in the form of a printed wiring board pad or PPP. The PPP (Pick-Place-Plate) can be used to reduce the contact resistance of an acoustic contact pin and PWB. The leaf spring 503 or any other suitable resilient member in some embodiments can mechanically bias the speaker module 201 from the printed wiring board 301 sufficiently to create a first void forming part of the back cavity 203.

In some embodiments the speaker module can be designed such that the casing of the speaker module is mechanically coupled to the printed wiring board. Although the following example show a rear cavity section between the speaker module 201 and the printed wiring board, it would be understood that in some embodiments the volume of rear cavity section between the speaker module 201 and the printed wiring board 301 is completely within the speaker module 201. In other words the speaker module is located on the printed wiring board 301 and the speaker module has an open face located over the capillary arrangement.

Figure 5:
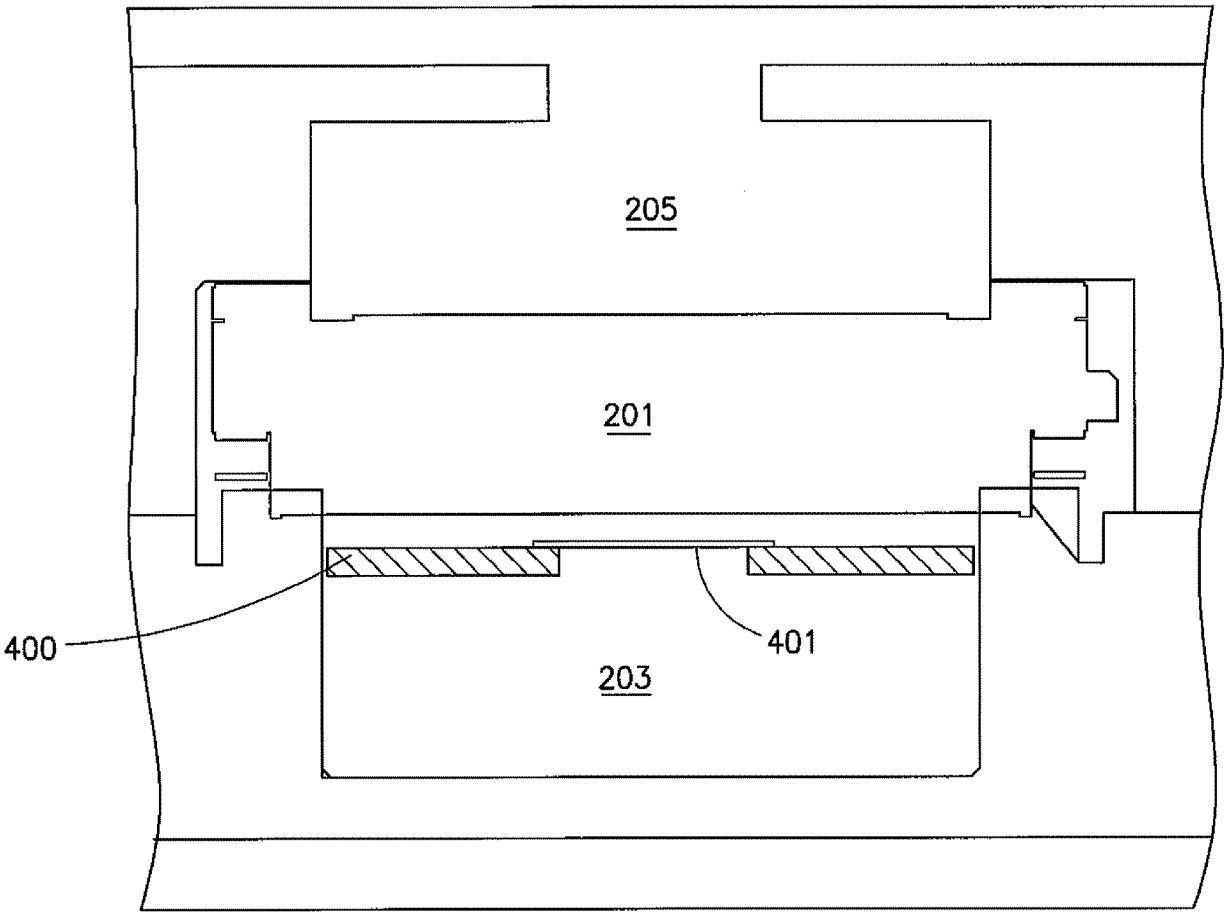
FIG. 5 shows schematically a further example sectioned view of a mobile apparatus speaker integration according to some embodiments.

With respect to FIG. 5 further example of the implementation of capillary damping is shown wherein the back cavity 203 is separated into two sections by a printed wiring board or similar sectioning part 400 on which is mounted a damping mesh 401. The damping mesh 401 can for example be a material layer with suitable capillary or hole array to damp the transfer of air between the back cavity sections. It would be understood that the damping mesh 401 can be fixed within or under the sectioning part 400, or in some embodiments may be a multi-layer mesh structure.

Figure 9:
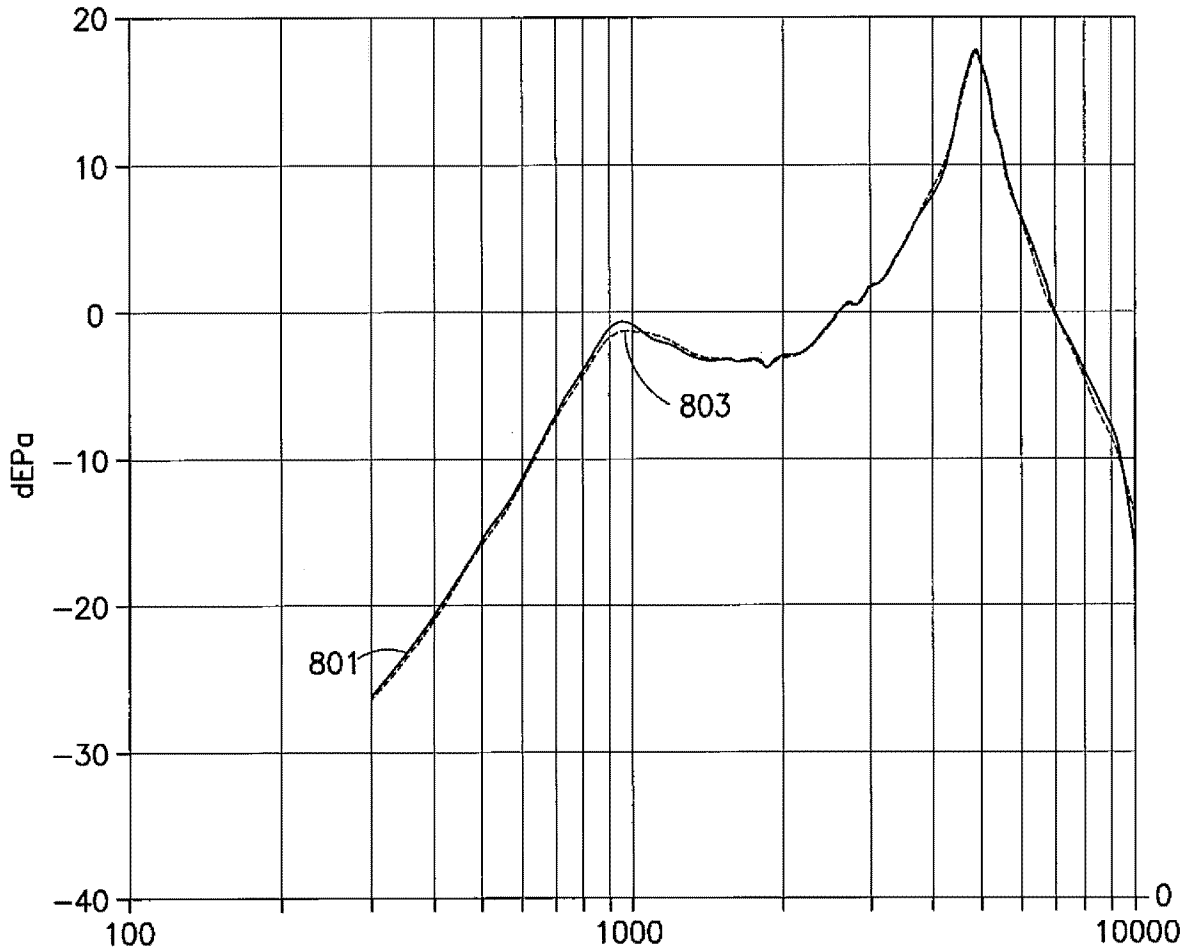
FIG. 9 shows a graph of an example mobile apparatus speaker integration speaker frequency response for conventional mobile speaker.

For example with respect to FIG. 9 an example frequency response for a mesh structure such as shown in FIG. 5 is shown. The graph in FIG. 9 shows frequency response for an acoustic damping Sefar 160-20 mesh with 4 layers. The mesh opening area has a diameter of 4 mm in a 13 mm×18 mm square section. As can be seen in FIG. 9 the difference between frequency responses between a capillaries—mesh structure trace or plot 803 and the empty or no mesh structure as shown by trace or plot 801 is minor. However the same examples show an excursion reduction from 0.633 mm to 0.457 mm.

Figure 10:
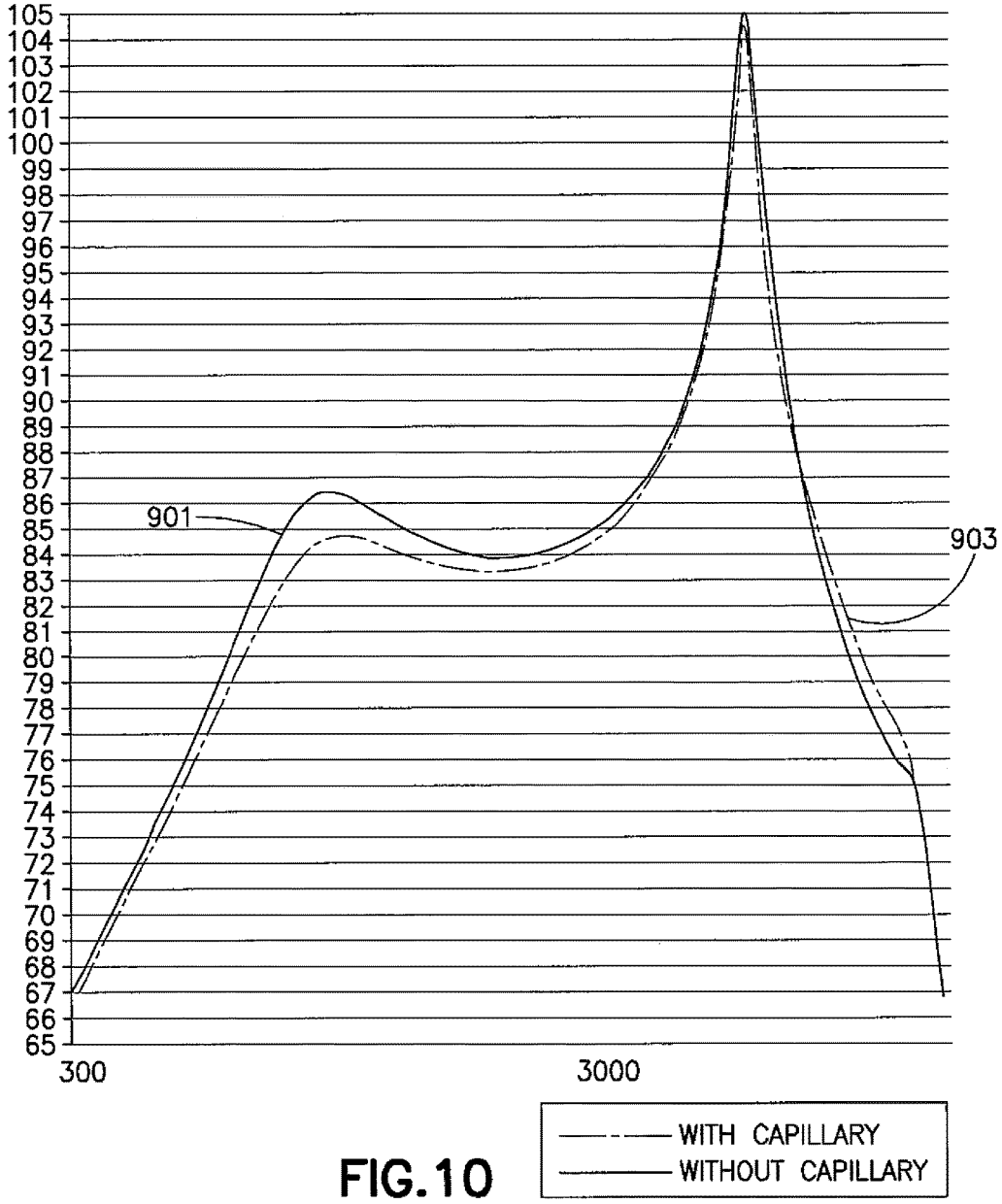
FIG. 10 shows a graph of an example frequency response for conventional mobile speaker integration and mobile speaker integration according to some embodiments.

Furthermore simulations show similar improvements. For example an example simulated high sensitivity speaker, which is 13×18×4.5 mm in size with sensitivity 87 dBSPL/1V/0.1 m; and with 700 mW power handling capacity implementation where there are 400 capillaries made in an 18 mm×13 mm square, and each capillary has the diameter 0.15 mm where and the printed wiring board is 0.8 mm high can be simulated which produces a frequency response such as shown in FIG. 10 where the trace of the frequency response without the capillaries 901 is similar to the trace of the frequency response of the simulated example capillary implementation 903. The simulated examples produce a sensitivity drop of only 1 dB.

Figure 11:
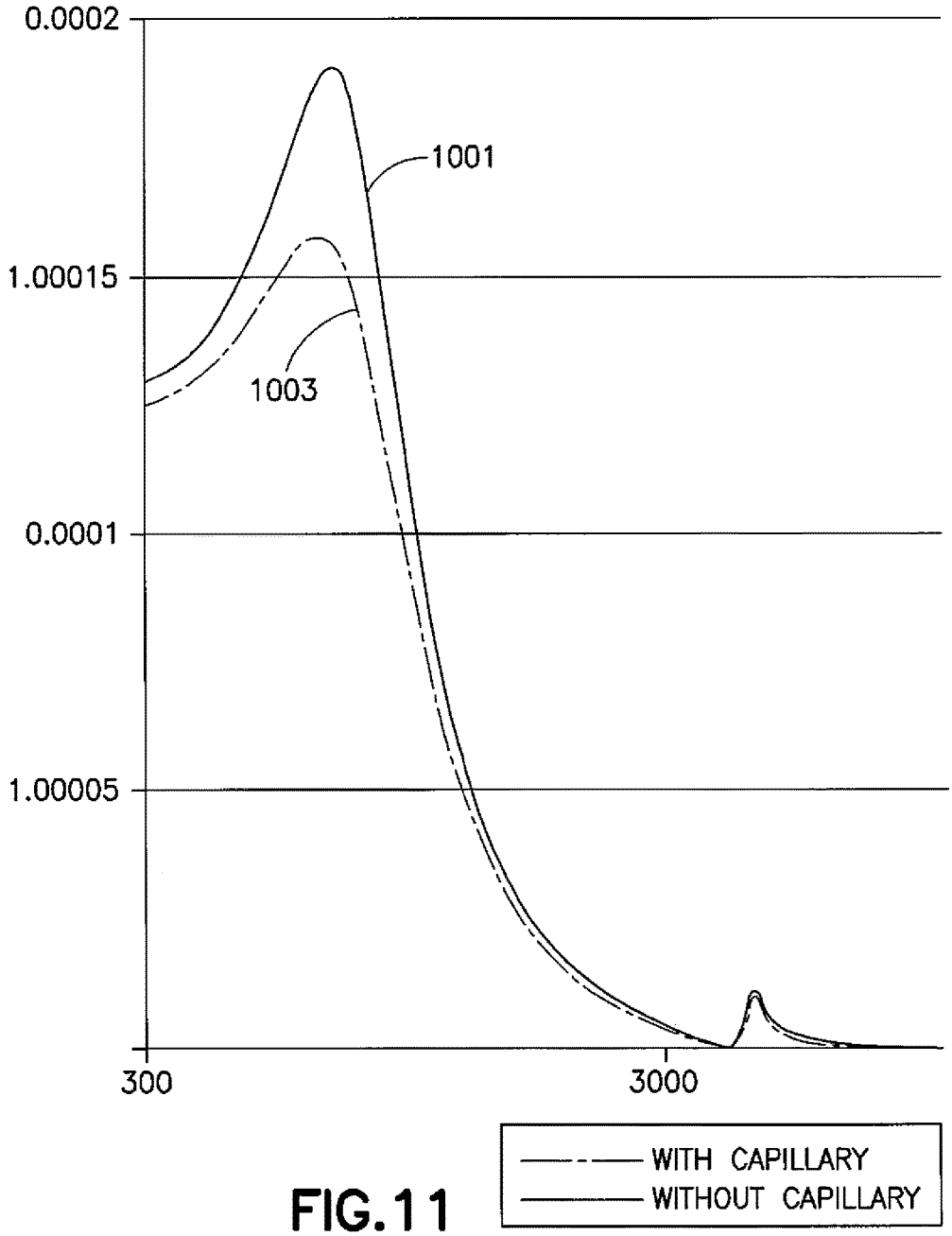
FIG. 11 shows a graph of an example excursion for conventional mobile speaker integration and mobile speaker integration according to some embodiments.

Furthermore with respect to FIG. 11 the simulated excursion with and without the capillary implementations is shown. The excursion without capillary implementation shown by trace 1001 and with capillary implementation shown by trace 1003 difference shows that the excursion drops by 20%.

Figure 8:
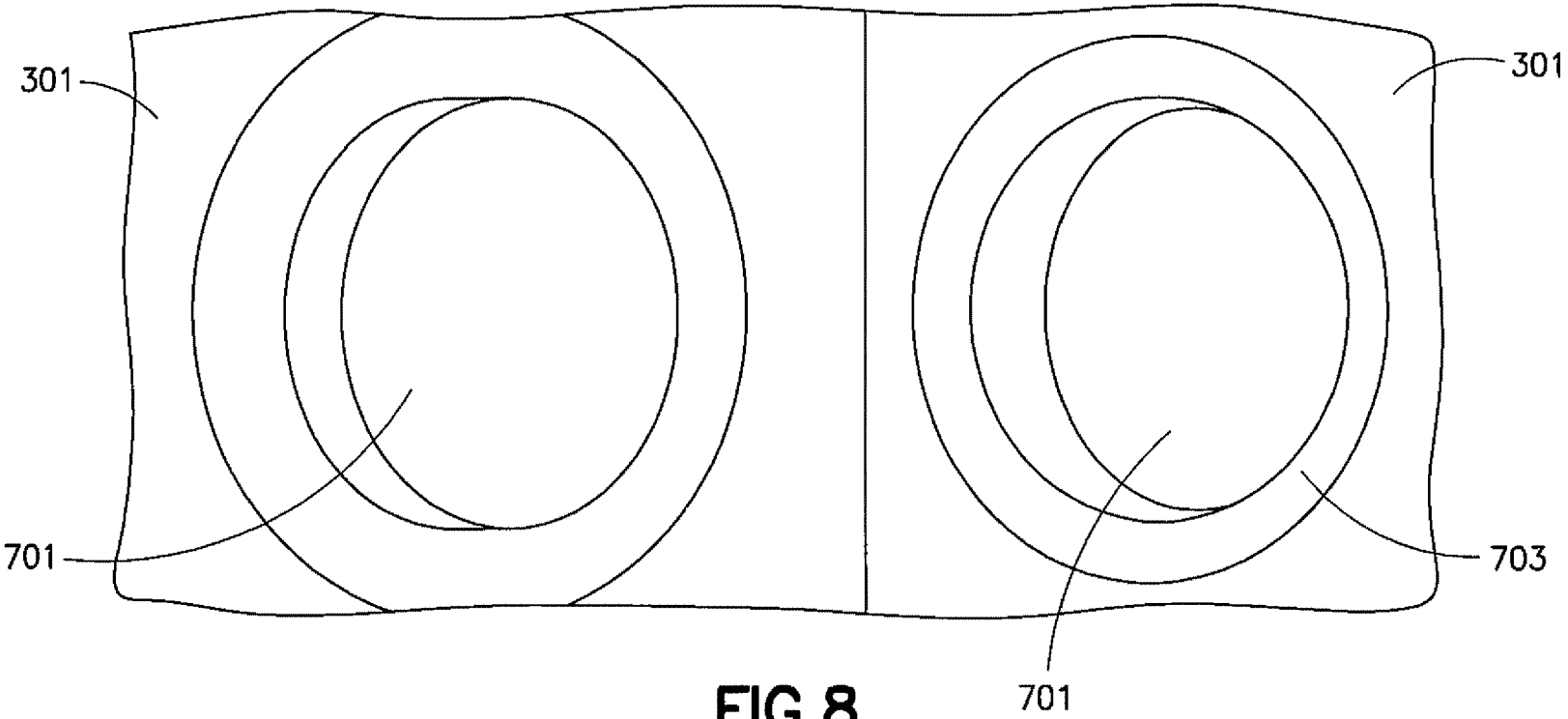
FIG. 8 shows schematically an example three dimensional view of plated and unplated through holes in the printed wiring board.

As an improvement to normal capillary material, in some embodiments the use of PWB capillary or holes can be further improved by the layer or plating of copper in the inner side of capillary which is good heating conductive material compared with normal material. With respect to FIG. 8 a plated and un-plated through hole configuration is shown. On the left-hand side of FIG. 8 an un-plated through hole 701 is shown through the printed wiring board 301. The right-hand side of FIG. 8 shows the printed wiring board 301 with a through hole 701 which is plated 703. It would be understood that the plating or a conductive material, for example copper, would enable a temperature or heat absorption element to be added to the damping characteristics where the heating exchange of between the air and copper absorbs more energy when sound is spreading through the capillary. In other words the resistance is increased in the capillary leading to additional damping effect. In theory the resistance can be increased to:

$$R = pc\frac{0.335}{d^2}\cdot\frac{t}{p}\cdot\left(\sqrt{1+\frac{x^2}{32}}+\frac{\sqrt{2}}{8}\cdot\frac{xd}{t}\right)$$

The capillaries perform acoustic damping which can be configured to prevent the speaker from overshooting or applied as a tunable element within the back cavity 203.

Figure 14:
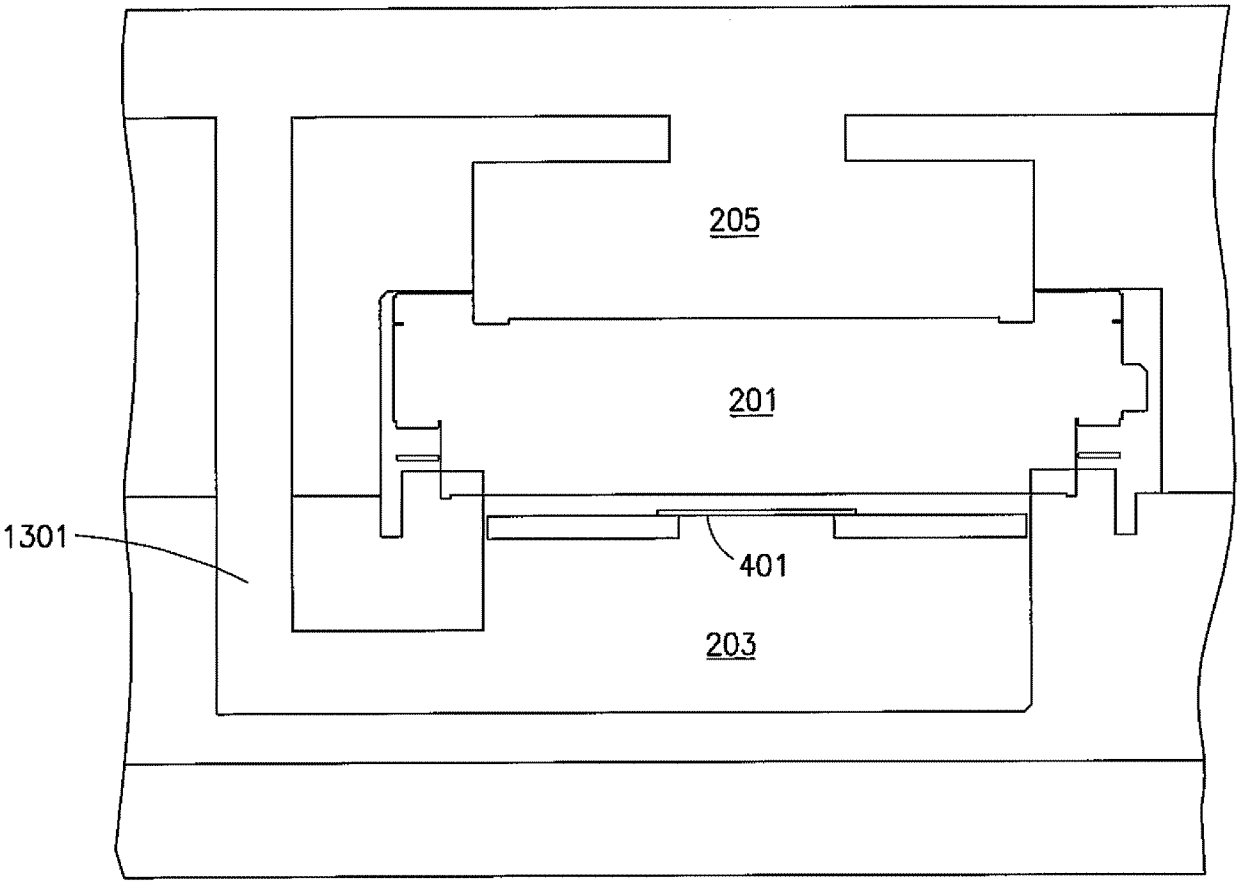
FIG. 14 shows schematically an example sectioned view of a mobile apparatus rear bass reflex speaker integration according to some embodiments.

With respect to FIG. 14 a further configuration of the hole or capillary damping is shown with respect to a vented box (or bass reflex) configuration. The configuration as shown in FIG. 14 is similar to that shown in FIG. 4 is shown where the back cavity 203 is vented by a vent 1301. However the mesh or printed wiring board separator 401 is shown between the speaker and the two rear cavities 203.

In the examples shown above the micro-hole or capillary damping is shown with respect to the rear acoustic cavity damping and furthermore with respect to a speaker transducer. However it would be understood that the application of micro-hole or capillary damping can be applied to front acoustic cavity damping. Furthermore it would be understood that in some embodiments the micro-hole or capillary damping can be applied to a microphone transducer implementation.

Figure 15:
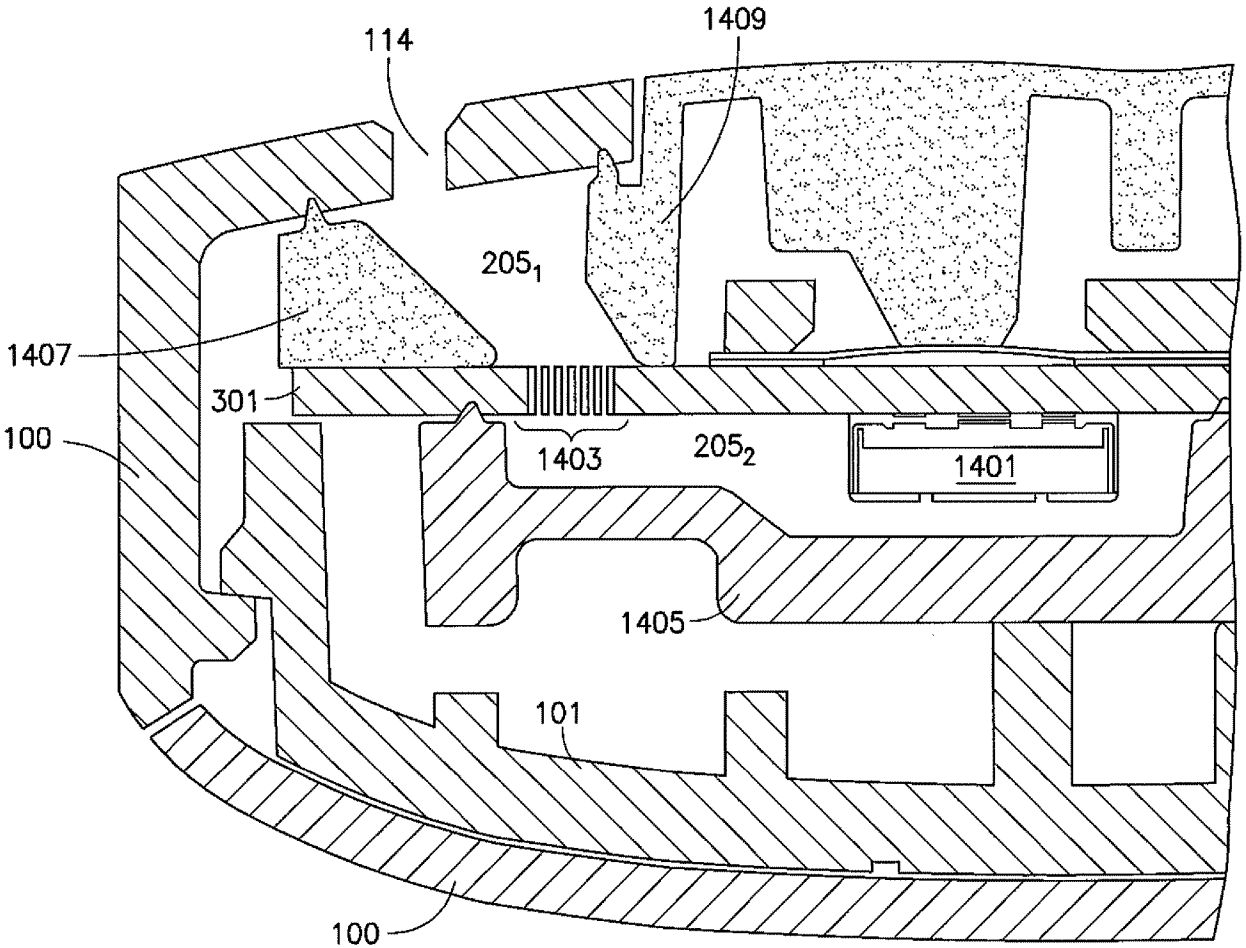
FIG. 15 shows schematically an example sectioned view of a mobile apparatus microphone integration according to some embodiments.

With respect to FIG. 15 an example sectioned view of a mobile apparatus microphone integration where micro-hole or capillary damping is applied to the front chamber is shown. The mobile apparatus comprises the cover 100 through which there is an opening 114 through which the acoustic waves can pass. Beneath the cover 100 and between the cover and the microphone module 1401 is the front cavity 205. Behind the front cavity 205 is the microphone module 1401 (or transducer). In the embodiments shown herein the microphone module 1401 is mechanically fixed to the printed wiring board 301 and sealing rubber sections 1405, 1407, and 1409 form a void between the cover 100 and the microphone module 1401 forming the front cavity 205. The front cavity 205 in the example shown in FIG. 15 is bisected or sectioned into at least two portions by the printed wiring board 301. Within the printed wiring board 301 is located a plurality of capillaries 1403 or tubes or holes which link the front cavity sections. In the example shown herein the front cavity 205 is bisected into a first part $\mathbf{205}_2$ which is directly coupled to the microphone module 1401 and a second part $\mathbf{205}_1$ which is coupled to the microphone module 1401 via the capillaries 1403 (and via the front cavity first part $\mathbf{205}_2$).

In the example shown in FIG. 15 the capillaries are formed or implemented within the printed wiring board, however it would be understood that in some embodiments the frequency dependent dampening (to reduce the Q-factor peak) can be implemented by locating the capillaries within the cover 100 or other part of the cavity perimeter. In other words the front cavity is damped by the implementation of capillaries which selectively frequency dampen the air flow in to and out of the cavity rather than through the cavity.

In the embodiments described herein the term cavity or acoustic cavity can be understood to be any acoustically configured volume, typically of air, but can be of any gaseous, liquid or otherwise material suitable for conducting and by virtue of the cavity walls filter acoustic waves into or from the transducer. As such the cavity can be an acoustic space such as an acoustic channel, an acoustic conduit or acoustic chamber.

It shall be appreciated that the term user equipment is intended to cover any suitable type of wireless user equipment, such as mobile telephones, portable data processing devices or portable web browsers, as well as wearable devices.

Furthermore elements of a public land mobile network (PLMN) may also comprise apparatus as described above.

In general, the various embodiments of the invention may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the invention may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this invention may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the inventions may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

The foregoing description has provided by way of exemplary and non-limiting examples a full and informative description of the exemplary embodiment of this invention. However, various modifications and adaptations may become apparent to those skilled in the relevant arts in view of the foregoing description, when read in conjunction with the accompanying drawings and the appended claims. However, all such and similar modifications of the teachings of this invention will still fall within the scope of this invention as defined in the appended claims.

What is claimed is:

1. An apparatus comprising:

an audio transducer configured to generate sound;

a housing component comprising one or more sound outlets configured to allow the transmission of sound in a first direction out of the apparatus, a second housing component comprising capillaries comprising two or more sound apertures that are positioned according to at least one of diameter, area, thickness, and distance between the two or more sound apertures, and configured to allow the transmission of sound from the audio transducer within the apparatus in a second direction different from the first direction and through the two or more sound apertures, inner surfaces of the capillaries being plated with a conductive material; and an acoustic cavity inside the apparatus being acoustically coupled to the audio transducer using the two or more sound apertures wherein the two or more sound apertures are configured to provide an acoustic damping.

2. The apparatus as claimed in claim 1, wherein the second housing component is one of: a printed wiring board; a chassis component; a rigid or semi-rigid structure; a sintered material structure; and adjacent to the acoustic cavity forming a cavity wall for the acoustic cavity and wherein the housing component is one of: a cover; a cover structure; a display window.

3. The apparatus as claimed in claim 1, wherein at least one of the two or more sound apertures have a diameter smaller than 0.5 mm.

4. The apparatus as claimed in claim 1, wherein the two or more sound apertures are configured with the conductive material to provide characteristics that are selected to provide a predetermined acoustic characteristic.

5. The apparatus as claimed in claim 4, wherein the selected characteristics of the two or more sound apertures include one or more of: diameter; area; pitch; thickness; pitch/diameter ratio; and total open area.

6. The apparatus as claimed in claim 1, wherein the acoustic cavity is formed as at least one of: a front cavity volume extending from the audio transducer in the first direction; and a rear cavity volume extending from the audio transducer in the second direction different from the first direction, for the audio transducer.

7. The apparatus as claimed in claim 1, wherein the acoustic cavity is a rear cavity volume that is substantially sealed inside the apparatus in such a way that air inside the rear cavity volume is prevented from mixing with frontal sound waves produced by the audio transducer.

8. The apparatus as claimed in claim 7, wherein the sealed rear cavity volume comprises sealing the acoustic coupling surface of the audio transducer around the two or more sound apertures.

9. The apparatus as claimed in claim 1, wherein the acoustic cavity comprises two parts bisected by the housing component, such that a first part of the acoustic cavity is acoustically coupled to the audio transducer using the two or more sound apertures and a second part of the acoustic cavity is directly coupled to the audio transducer.

10. The apparatus as claimed in claim 1, wherein the audio transducer is located between the one or more sound outlets and the two or more sound apertures.

11. The apparatus as claimed in claim 1, wherein the conductive material is copper.

12. The apparatus as claimed in claim 1, wherein the transmission of sound from the audio transducer in the second direction different from the first direction is vented out of the apparatus by a vent.

13. A method comprising:

providing an audio transducer configured to one of: generate sound in a first direction upon receiving an audio signal provided by an apparatus; and convert sound into an audio signal to be processed by the apparatus;

providing a housing component comprising one or more sound outlets configured to allow the transmission of sound in the first direction out of the apparatus, and providing a second housing component comprising capillaries comprising two or more sound apertures that are positioned according to at least one of diameter, area, thickness, and distance between the two or more sound apertures, and configured to allow the transmission of sound from the audio transducer in a second direction different from the first direction and through the two or more sound apertures, inner surfaces of the capillaries being plated with a conductive metal, wherein the audio transducer is located between the one or more sound outlets and the two or more sound apertures; and providing an acoustic cavity inside the apparatus being acoustically coupled to the audio transducer using the two or more sound apertures wherein the two or more sound apertures are configured to provide an acoustic damping.

14. The method as claimed in claim 13, wherein the second housing component is at least one of: a printed wiring board; a chassis component; a rigid or semi-rigid structure; and a sintered material structure; and wherein the housing component is at least one of a cover; a cover structure; and a display window.

15. The method as claimed in claim 13, further comprising locating the second housing component adjacent to the acoustic cavity forming a cavity wall for the acoustic cavity.

16. The method as claimed in claim 13, wherein at least one of the two or more sound apertures have a diameter smaller than 0.5 mm.

17. The method as claimed in claim 13, further comprising selecting at least one characteristic of the two or more sound apertures and configuring the conductive material to provide a predetermined acoustic characteristic.

18. The method as claimed in claim 17, wherein the at least one characteristic comprises one or more of: pitch; pitch/diameter ratio; and total open area.

19. The method as claimed in claim 13, wherein providing the acoustic cavity comprises forming the acoustic cavity as at least one of: a front cavity volume extending from the audio transducer in the first direction; and a rear cavity volume extending from the audio transducer in the second direction different from the first direction for the audio transducer.

20. The method as claimed in claim 13, further comprising sealing substantially a rear cavity volume of the acoustic cavity inside the apparatus in such a way that air inside the rear cavity volume is prevented from mixing with frontal sound waves produced by the audio transducer.

21. The method as claimed in claim 20, wherein sealing substantially the rear cavity volume comprises sealing the acoustic coupling surface of the audio transducer around the two or more sound apertures.

22. The method as claimed in claim 13, wherein providing the acoustic cavity comprises forming the acoustic cavity in two parts bisected by the housing component, such that a first part of the acoustic cavity is acoustically coupled to the audio transducer using the two or more sound apertures and a second part of the acoustic cavity is directly coupled to the audio transducer.

23. The method of claim 13, wherein inner surfaces of the capillaries are plated with copper.

24. The method as claimed in claim 13, further comprising venting the transmission of sound from the audio transducer out of the apparatus in a second direction different from the first direction.

* * * * *